United States Patent [19]

Williams

[11] 4,130,179

[45] Dec. 19, 1978

[54] PORTABLE SUPPORT FOR A SCAFFOLD

[76] Inventor: Albert Williams, 4506 Laurel Ave., Omaha, Nebr. 68104

[21] Appl. No.: 851,362

[22] Filed: Nov. 14, 1977

[51] Int. Cl.[2] ..... E04G 3/10

[52] U.S. Cl. ..... 182/142; 182/150

[58] Field of Search ..... 182/142, 143, 144, 2, 182/63, 36; 52/127; 254/139.1

[56] References Cited

U.S. PATENT DOCUMENTS

| | | | |
|---|---|---|---|
| 2,481,223 | 9/1949 | Johnson | 254/139.1 |
| 3,182,827 | 5/1965 | Frost | 182/2 |
| 3,854,550 | 12/1974 | Shingler | 182/142 |

*Primary Examiner*—Reinaldo P. Machado

*Attorney, Agent, or Firm*—Zarley, McKee, Thomte, Voorhees & Sease

[57] ABSTRACT

A portable support for a scaffold comprising first and second wheeled support members which are adapted to be placed on the building roof. The first support member has a pair of upstanding posts secured thereto for selectively vertically receiving one end of an elongated scaffold support arm. A plurality of weights are removably mounted on spaced-apart upstanding rods. The second support member has a pair of posts secured thereto and extending upwardly therefrom for receiving the scaffold support arm therebetween. The scaffold support arm is selectively vertically positioned between the upstanding posts on the second table by means of a bolt extending therethrough. The outer end of the scaffold support arm has the scaffold operatively secured thereto.

3 Claims, 6 Drawing Figures

PORTABLE SUPPORT FOR A SCAFFOLD

BACKGROUND OF THE INVENTION

This invention relates to a support for a scaffold and more particularly to a portable scaffold support.

Many types of scaffold support devices have been provided for supporting a scaffold along one side of a building or the like. Ordinarily, long timbers or poles are extended over the side of the building and are sandbagged or the like to maintain the same in position. The scaffolds are supported on the outer end of the timbers. When it is necessary to move the scaffold along the side of the building, it is necessary to completely disassemble the entire structure and to laboriously move the sandbags to the new position.

Certain types of scaffold supports have been designed to overcome the shortcomings of the previously described support but they are either not convenient to use or are too expensive to manufacture.

Therefore, it is the principal object of the invention to provide an improved support for a scaffold.

A further object of the invention is to provide a portable support for a scaffold.

A still further object of the invention is to provide a portable support for a scaffold wherein a plurality of weights may be selectively mounted thereon according to the amount of scaffold weight.

A still further object of the invention is to provide a portable support for a scaffold including means for adjustably securing the scaffold support arm.

A still further object of the invention is to provide a portable support for a scaffold which may be easily moved from one location to another on the building roof.

A still further object of the invention is to provide a portable support for a scaffold which is economical of manufacture, durable in use and refined in appearance.

DESCRIPTION OF THE PREFERRED EMBODIMENT

Figure 1:
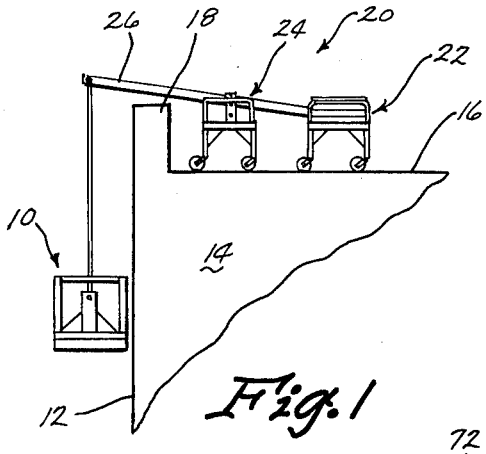
FIG. 1 is a perspective view of the scaffold being used on a building.
Figure 4:
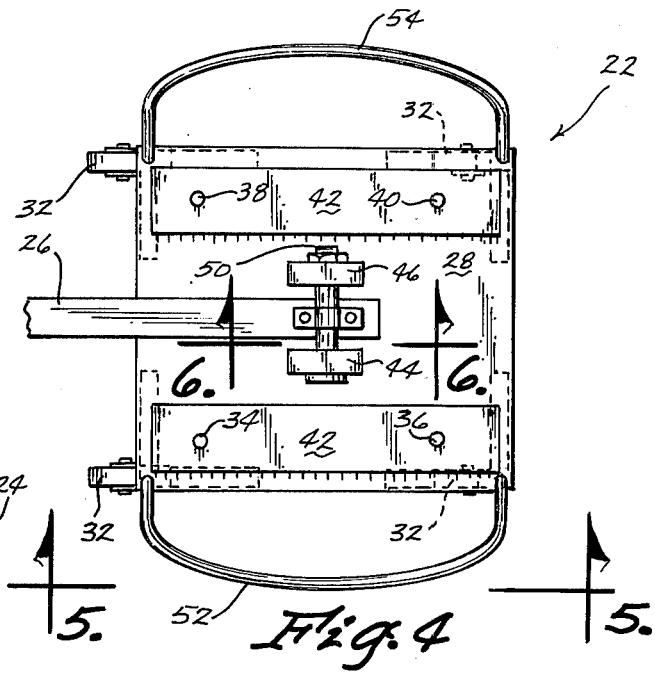
FIG. 4 is a sectional view as seen on lines 4—4 of FIG. 2.
Figure 2:
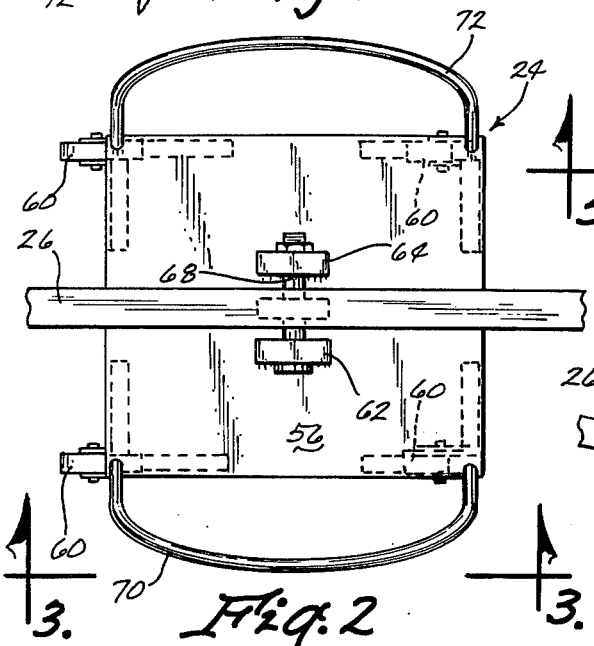
FIG. 2 is a top view of the rear support.
Figure 5:
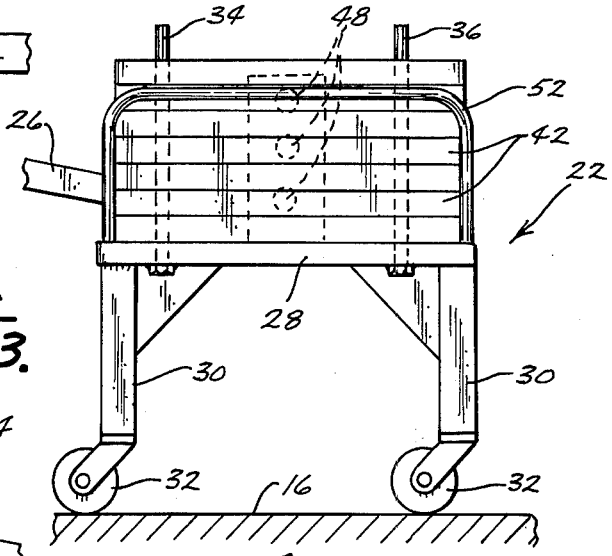
FIG. 5 is a sectional view as seen on lines 5—5 of FIG. 3.
Figure 3:
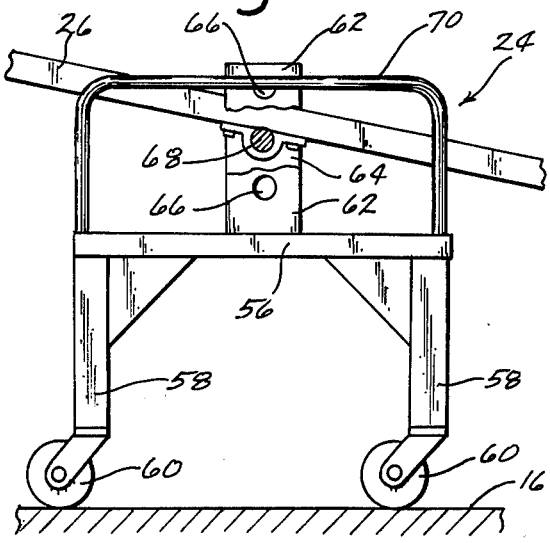
FIG. 3 is a top view of the outer support.
Figure 6:
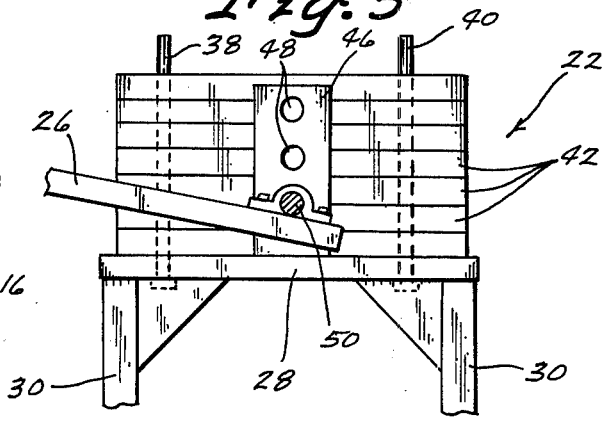
FIG. 6 is a sectional view as seen on lines 6—6 of FIG. 3.

The numeral 10 refers generally to a conventional scaffold which is normally positioned along the face or side 12 of a building 14. The scaffold can include means for raising and lowering the same relative to the building. For purposes of description, the building 14 will be described as including a roof 16 and a ledge 18.

The support of this invention is referred to generally by the reference numeral 20 and generally comprises supports 22 and 24 and support arm 26. Support 22 generally comprises bed 28 having legs 30 extending downwardly therefrom which have casters 32 on the lower ends thereof. A pair of posts 34 and 36 are secured to the bed 28 and extend upwardly therefrom as do posts 38 and 40. Posts 34, 36 and 38, 40 are adapted to receive a plurality of weights 42 thereon as seen in the drawings. The number of weights positioned on the post will depend upon the weight being supported from the member 26. A pair of posts 44 and 46 are secured to the bed 28 and extend upwardly therefrom. The posts 44 and 46 are provided with a plurality of vertically spaced openings 48 formed therein adapted to receive the bolt 50. One end of the arm 26 is selectively vertically received between the posts 44 and 46 and secured thereto by means of the bolt 50. Support 22 is provided with handles 52 and 54.

Support 24 generally comprises bed 56 having legs 58 extending downwardly therefrom which have casters 60 on the lower ends thereof. A pair of posts 62 and 64 are secured to the bed 56 and extend upwardly therefrom. Posts 62 and 64 are provided with a plurality of vertically spaced openings 66 formed therein adapted to receive the bolt 68. As seen in the drawings, arm 26 extends between the posts 62 and 64 and is selectively vertically secured thereto by means of the bolt 68 extending therethrough. Support 24 is provided with handles 70 and 72.

The normal method of operation is as follows. The supports 22 and 24 and the arm 26 are normally disassembled and would be taken to the roof of the building in a disassembled condition. After positioning the components on the roof, support 24 is positioned near the ledge 16 and the support 22 is positioned inwardly with respect thereto. One end of the arm 26 is selectively vertically secured to the posts 44 and 46 by the bolt 50. Support arm 26 is selectively vertically secured to the posts 62 and 64 by the bolt 68. The particular vertical positioning of the arm 26 with respect to the supports 22 and 24 will depend upon the height of the ledge 18 with respect to the roof 16. The weights 42 are then placed on the posts 34, 36, 38 and 40 and the number of the weights will depend upon the weight of the scaffold and the weight being supported thereon. The scaffold itself is secured to the outer end of the arm 24 in conventional fashion. When it is desired to move the scaffold laterally along the side of the building, it is simply necessary to roll the supports 22 and 24 sideways or laterally to reposition the scaffold. It can be appreciated that the structure described herein permits the scaffold to be easily moved from one location to another location on the building roof without the inconvenience associated with the prior art devices.

The support disclosed herein is not only convenient to use but is safe and versatile. Thus it can be seen that the invention described herein accomplishes at least all of its stated objectives.

I claim:

1. A portable support for a scaffold, comprising, a first portable support member, a plurality of weights on said first support member, an elongated member having one end pivotally connected to said first support member, a second portable support member spaced from said first support member, said elongated member being connected, intermediate its length, to said second support member, the other end of said elongated member being adapted to support a scaffold extending downwardly therefrom, said elongated member being selectively vertically secured to said first support member.

2. The structure of claim 1 wherein said elongated member is selectively vertically secured to said second support member.

3. A portable support for a scaffold, comprising, a first portable support member, a plurality of weights on said first support member, an elongated member having one end pivotally connected to said first support member, a second portable support member spaced from said first support member, said elongated member being connected, intermediate its length, to said second support member, the other end of said elongated member being adapted to support a scaffold extending downwardly therefrom, said first support member having first and second pairs of spaced-apart rods secured thereto and extending upwardly therefrom, said weights being removably received on said pairs of rods.

* * * * *